US008226458B2

(12) United States Patent
Aguado Vitas et al.

(10) Patent No.: US 8,226,458 B2
(45) Date of Patent: Jul. 24, 2012

(54) COIN DISPENSER

(75) Inventors: Jesús María Aguado Vitas, Peralta (ES); Miguel A. Calleja Lafuente, Peralta (ES); Juan Miguel Irurita Loyarte, Peralta (ES); Oscar Lacarra Fernandez, Peralta (ES); Alvaro Martinez Chavoy, Peralta (ES); Bernardo Sola Sanchez, Peralta (ES)

(73) Assignee: Azkoyen SA, Peralta, Navarra (ES)

( * ) Notice: Subject to any disclaimer, the term of this patent is extended or adjusted under 35 U.S.C. 154(b) by 210 days.

(21) Appl. No.: 12/718,740

(22) Filed: Mar. 5, 2010

(65) Prior Publication Data

US 2010/0227539 A1 Sep. 9, 2010

(30) Foreign Application Priority Data

Mar. 5, 2009 (ES) ..... 200900623

(51) Int. Cl.
*G07D 1/00* (2006.01)
*B65H 3/36* (2006.01)

(52) U.S. Cl. ..... 453/56; 221/253

(58) Field of Classification Search ..... 453/7, 11, 453/56; 198/850–853, 607; 221/77, 78, 221/253, 254
See application file for complete search history.

(56) References Cited

U.S. PATENT DOCUMENTS

| | | | | |
|---|---|---|---|---|
| 3,703,903 | A | 11/1972 | Landis et al. | |
| 3,910,295 | A | 10/1975 | Fletcher | |
| 4,535,794 | A * | 8/1985 | Bellis et al. | 453/56 |

FOREIGN PATENT DOCUMENTS

| | | |
|---|---|---|
| EP | 1 020 818 | 7/2000 |
| EP | 1 283 505 | 2/2003 |
| WO | WO 98/13792 | 4/1998 |
| WO | WO 2006/003212 | 1/2006 |

* cited by examiner

*Primary Examiner* — Mark Beauchaine
(74) *Attorney, Agent, or Firm* — Merchant & Gould P.C.

(57) ABSTRACT

Coin dispenser comprising a coin storage unit, a coin extractor (2) comprising an endless chain (3), a coin identifier (4) for the coins transported by the endless chain, and a coin deflector (8). The endless chain (3) comprises two series of flat alternating links, parallel to the plane defined by said chain and consecutively articulated according to two axes perpendicular to the links, forming open cavities (40) all along the chain, each one of said cavities being able to transport a coin (7) in a position parallel to the bottom of said cavity.

9 Claims, 10 Drawing Sheets

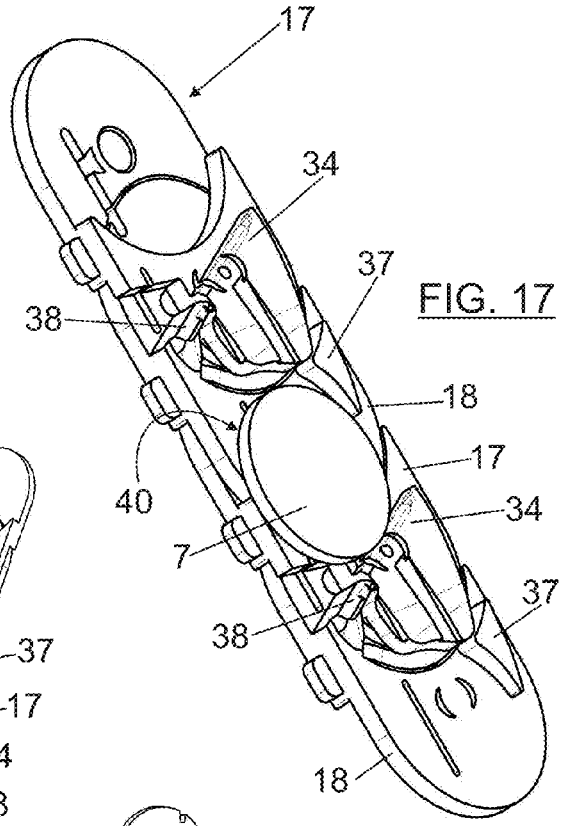
FIG. 17
FIG. 18
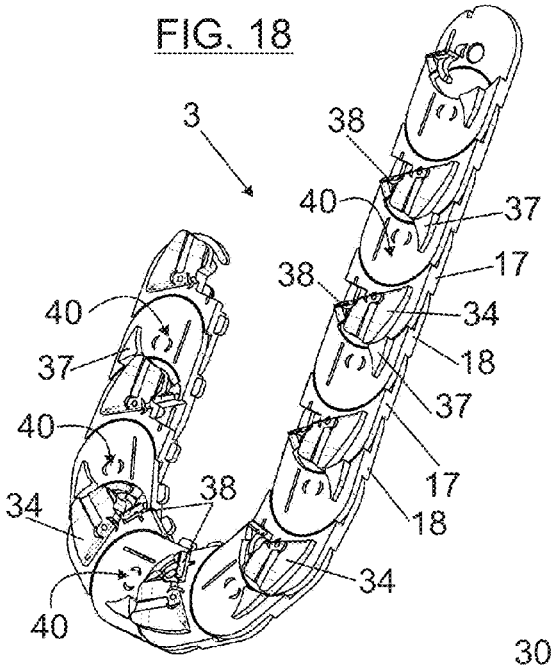
FIG. 19
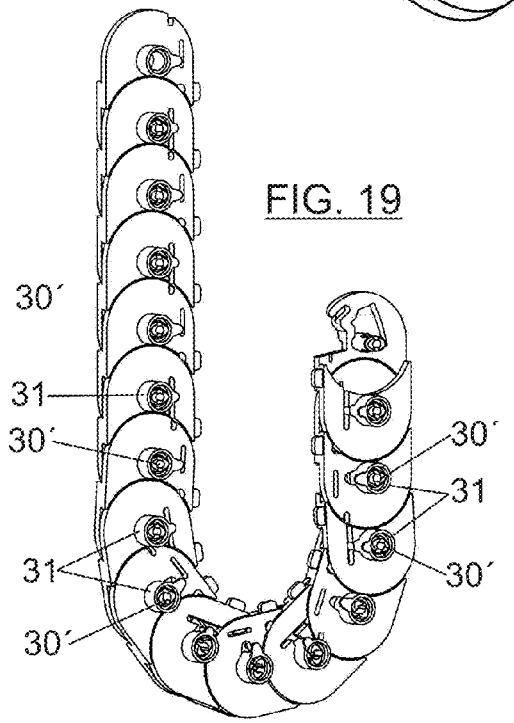

COIN DISPENSER

This application claims benefit of Ser. No. 200900623, filed 5 Mar. 2009 in Spain and which application is incorporated herein by reference. To the extent appropriate, a claim of priority is made to the above disclosed application.

FIELD OF THE INVENTION

The present invention refers to a coin dispenser, conceived to be used as a coin returner in automatic vending machines, recreational machines, parking fee collection, etc.

The dispenser of the invention is of the type comprising a coin storage unit, a coin extractor, a coin identifier of the coins transported by the extractor, and a coin deflector in charge of directing the coins provided by the extractor towards the outlet way or return path, or towards a return or recovery path, so that coin return is carried out selectively, according to their denomination, detected in a previous phase by the coin identifier.

More specifically, the coin dispenser of the invention is of the type in which its extractor is constituted by an endless chain, mounted between two sprockets.

BACKGROUND OF THE INVENTION

Coin dispensers used as coin returners in recreational machines, vending machines, etc. are already known.

In the current state of the art the following documents can be mentioned as background.

The document EP 1020818 describes a coin return mechanism based on a rotary disk in which the coins are transported to the outlet, once they are measured. Close to the outlet there exists a deflector so that in the event that the coin extraction is not desired, the coin is sent back to the inside of the device. This system has the inconvenience that it does not allow vertical growth in order to increase coin capacity. In some applications the capacity is increased by supplementary containers, but they have the inconvenience of their high volume compared to the obtained capacity. Another problem of this type of devices is that the coins are not extracted, they come back to the interior in a position close to the coin collection point, which is inconvenient since the coins which have not been extracted, since they do not correspond to the appropriate value, are better recycled as far away from coin collection by the extractor mechanisms as possible, thus enabling the arrival of different coins and therefore an appropriate coin recycling. By contrast, in the event the coins are rejected, the coins that have been rejected may be collected and rejected again.

The document WO 9813792 describes a coin roll or coin packet conveyor through a chain, to which buckets have been added to enable said transport. This mechanism is not fit for individual coin transport, nor is the function to discriminate between different types of coins described.

In the mechanism of WO 2006003212 a chain is used for coin extraction, said chain having links which are perpendicular to the plane defined by said chain. The coins are transported individually on the inner face of each one of the links and rest on a sloping ramp engraved on each link. The gears to allow the chain traction are located on the outer edge of the links. This mechanism has the inconveniences that the coin is extracted under the maximum elevation of the mechanism and at the outlet in a vertical plane a wide outlet mouth is needed, which complicates the corresponding coin guides. On the other hand, lateral transmission considerably increases the friction of the chain with the guides, resulting in a life reduction for the device and greater power of the track motor.

The document U.S. Pat. No. 3,910,295 refers to a coin vending machine where a chain is used for its transport, in the links of which there are alternating longer axes which serve as support for the chains. Therefore, the coins fit perpendicularly into the chain between two axes and rest on the sides of a vertical guide, in which the chain is centered. This system has the inconveniences that it allows a small range of coin sizes, upwardly limited by the width of the guide and downwardly limited by half said width. There also exists instability in the coin position which would make difficult its measuring before its extraction or recycling.

The document U.S. Pat. No. 3,703,903 refers to a coin vending machine consisting of a rigid cylinder having coin housings in the outer border. This system has problems to work with coins having an important range of diameters or thicknesses. It does not allow vertical growth without increasing the other dimensions, which is not useful when a considerably capacity and low volume are needed.

Finally, the document EP 1283505 B1 describes a conventional coin returning device, of the disk type, in which a supplementary storage unit is used to increase its capacity. The storage unit has a chain transport system similar to the previously described one in WO 2006003212. This system has the inconveniences of needing an important volume together with a considerable increase in the complexity of the mechanisms.

DESCRIPTION OF THE INVENTION

The object of the present invention is a coin dispenser, of the type previously stated, which offers great capacity to contain different value and dimension coins and presents proportionally reduced dimensions, enabling its use in applications in which the space occupied is a limitation. The coin dispenser of the invention is also of simple and robust construction, which also facilitates its use in the applications requiring low cost and high reliability, as is the case for example of parking lot ticket machines, vending machines, recreational machines or gambling machines, etc. The coin dispenser of the invention also enables, if necessary, to increase the capacity to contain coins through an increase of its vertical dimension.

Another advantage of the coin dispenser of the invention is that the coins that return to the storage unit can do so towards far-away positions to the point where they are collected by the extractor, thus enabling the arrival to the coin collection point.

In the coin dispenser of the invention the coin extractor is constituted by an endless chain which is mounted between an upper sprocket and a lower sprocket which delimit upward and downward straight sections and upper and lower curved sections in the chain. Preferably, the traction of the chain will be attained through the lower sprocket, which will be activated by a gear reduction motor.

In the dispenser of the invention, the endless chain comprises a first and second series of alternating flat links, parallel to the plane defined by said chain and consecutively articulated between them according to axes which are perpendicular to the links. Between the links of the two series of the chain, there are formed, on one of its surfaces and all along said chain, open cavities with the right dimensions to house a coin. These cavities are internally limited by a bottom which is parallel to the links and which comprises two consecutive links of different series. The aforementioned cavities are peripherally limited by ribs protruding from the two consecutive links which define the bottom of the cavities and the link located immediately in front of and behind said two consecutive links. That is, the bottom of each cavity comprises two consecutive links, while it is peripherally limited by projections belonging to four links.

The ribs peripherally limiting the cavities delimit, at least by the inner side of the chain, an outlet way which is wider than the diameter of the biggest coin.

According to another aspect of the invention, the chain is mounted, at the side opposite the one occupied by the cavities, between the aforementioned upper and lower sprockets, in a tilted position, so that the upper and lower straight sections run with an inclination towards the rear end in an upward direction. In that way, the coins which are dragged through the chain cavities rest on the bottom of the cavities, parallel to said bottom, in a position also inclined towards the back in upward direction, thus preventing that the coins may accidentally fall from the frontally open cavities. Besides, the upward section of the chain is limited, at the inner side in which the outlet ways are located, by a wall or stops closing said paths, also preventing the outlet of the coins go through that side, and end when the chain reaches the upper curved section, to enable the transported coins to drop freely because of gravity on the coin deflector.

The links of the two series are constituted by equal plates, with the same outline and dimensions, which are longer than they are wide and which are limited by straight and parallel longitudinal edges and transversal semicircular edges of the same radius. These plates have on both surfaces, from opposite semicircular edges and all along their width, recessed areas which are interiorly limited by a circular transversal curve-concave step, the radius and center of which coincide with the radius and center of the free semicircular opposite edges, with which they define a circular outline at each side. For the formation of the chain, each link is attached through its recessed areas to recessed areas of the adjacent links, being related thereto by articulation axes which are perpendicular to the steps and coincide with the center of the transversal semicircular edges of the plates forming the links.

The plates forming the links of the two series will be as wide as the diameter of the semicircular transversal edges of the plates, and their length will be between said diameter and the double thereof. As for the recessed areas forming the links they will be as deep as half the thickness of said plates. This depth will preferably be equal to or greater than the thickness of the coins to be transported.

With the constitution described, the chain constituting the coin extractor is mounted in an inclined position inside the coin storage unit, so that they will be randomly housed in the cavities of the lower curved section of the chain, being supported by one of its faces in the bottom of the cavities, while on the edge they rest on the plate ribs, the coins circulating in a plane parallel to the chain rotation. When the coins reach the upper section of the chain, at the end of the wall closing the outlet ways, the coins fall vertically because of gravity towards the deflector. This arrangement has the advantage that the coin needs very little time to abandon the chain, unlike those mechanisms where there exists a sloping ramp, which require more time for coin deflection. This characteristic allows greater speed in the extraction mechanism of the invention and, therefore, greater coin payment speed.

The coin deflector consists of an electromagnet-activated blade, having the function of ejecting the coin towards the outside or recycling it towards the inside, to go to the storage unit again, thus preventing the coin from being processed again. Before the deflector, there is a coin identification station, through the measuring of the dimensional characteristic and alloy of the coins. In this way, it can be decided on a position for the deflector, and thus the payment or recycling of the coin, according to the payment conditions required in that moment.

One of the plates forming the links of the chain of the invention has a notch or opening which facilitates the fall of the coins when they reach the upper curved section of the chain. In order to prevent coins from entering this opening in the lower curved section of the chain, the plates forming the links of the chain have coplanar bowed pins, which are coupled to one another when the chain reaches the curved sections, thus preventing the coins from accidentally getting into undesired positions in the lower curved section.

The articulation axes between links can be constituted by a male pivot and a female pivot, protruding from each link, by the surface opposite the one occupied by the ribs limiting the cavities for the coins, and coinciding with the center of the transversal curved edges of the plates forming the links. The female pivot will feature a pass-through housing through the plate, to receive the male pivot of another plate forming one of the adjacent links. Through these male and female pivots, the chain will be mounted on the toothed wheels.

The bottom of the cavity is formed by a surface of non recessed areas of two consecutive links. From this surface there protrudes, in the links of the first series, a rib occupying almost all the non recessed surface and limiting two consecutive cavities on the rear and front areas thereof, in the forward direction of the chain. In the links of the second series of the same non recessed area there protrude two small ribs partially limiting two consecutive cavities, as an extension of the front and rear borders of the rib of the first series.

BRIEF DESCRIPTIONS OF THE DRAWINGS

The following drawings show a possible embodiment of a coin dispenser, constituted according to the invention presented as a non-limiting example thereof, and where:

FIG. 17 shows a perspective frontal view of the same links of FIG. 15.

FIG. 18 shows a partial perspective frontal view of the chain formed by the two links of FIGS. 6 to 13, arranged in alternating positions.

FIG. 19 shows a partial perspective rear view of the same chain.

DETAILED DESCRIPTION OF AN EMBODIMENT

The constitution, characteristics and advantages of the coin dispenser of the invention will be understood better with the following description, with reference to the attached drawings, in which a non-limiting example of an embodiment is shown.

Figure 1:
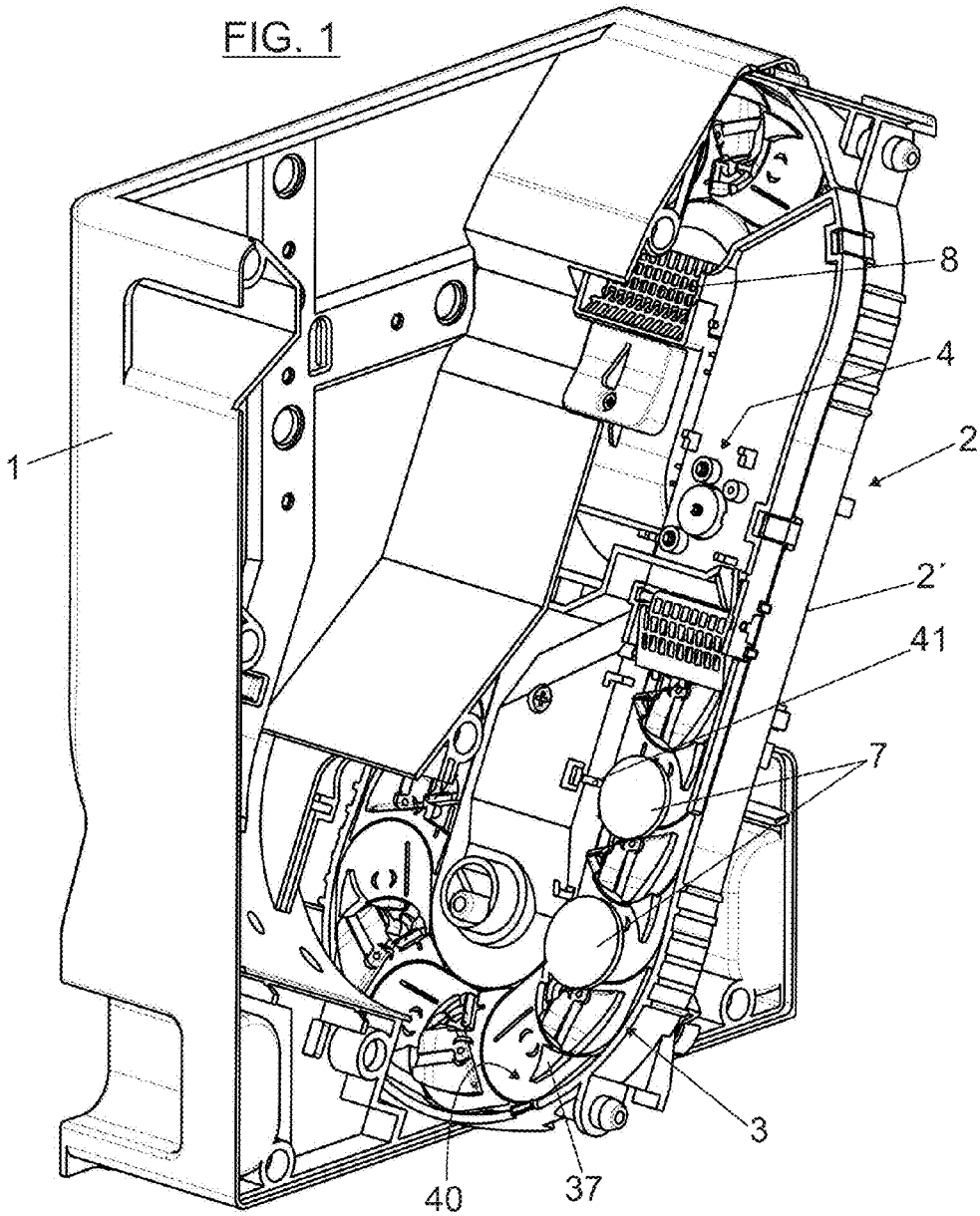
FIG. 1 is a perspective view of the dispenser storage unit, in which the front half of the wall has been suppressed to show the arrangement of the chain which constitutes the coin extractor.
Figure 4:
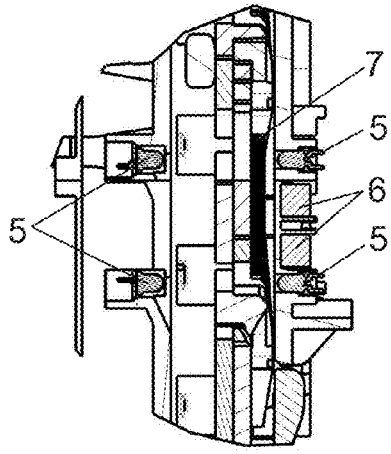
FIG. 4 is a longitudinal partial sectional view of the coin extractor, taken according to the cut line IV-IV of FIG. 3.
Figure 5:
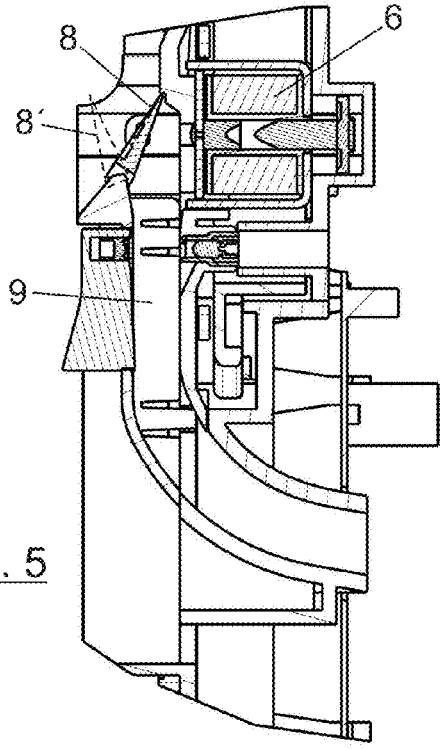
FIG. 5 is a longitudinal partial sectional view of the coin extractor, taken according to the cut line V-V of FIG. 3.

The dispenser shown in the drawings comprises a bucket 1 which constitutes a coin storage unit, FIG. 1, inside which there is mounted a coin extractor 2 comprising an endless chain 3 and having a coin identifier 4, constituted for example by elements 5 and 6, FIG. 4, capable of measuring the dimensional and electromagnetic characteristics of the coins 7 dragged by the chain 3, for their identification. The extractor 2 also includes a coin deflector constituted by a gate 8 which, as it can be seen better in FIG. 5, can swing between a position shown by a solid line, in which it intercepts the fall of the coin into a return channel 9 and takes it back to the storage unit 1, and a position 8', represented by broken lines, in which it directs the fall of the coin into the channel or exit way or return path 9.

Figure 20:
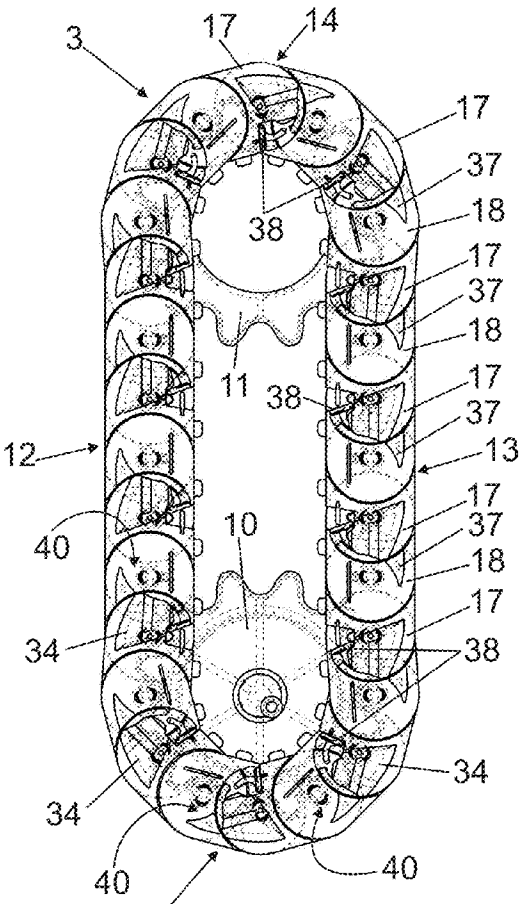
FIG. 20 shows an elevated frontal view of the chain forming the coin extractor of the dispenser of the invention.
Figure 21:
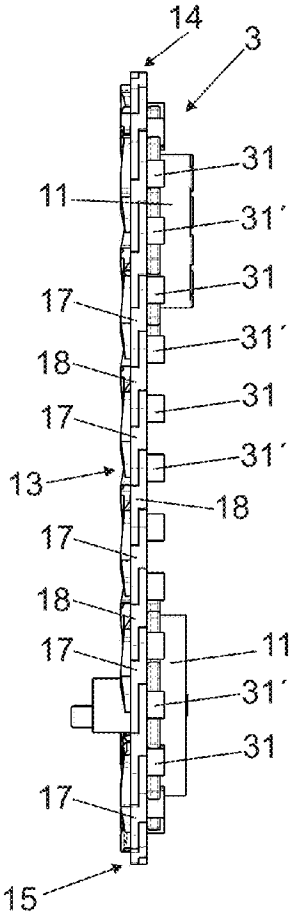
FIG. 21 shows a lateral view of the same chain.
Figure 22:
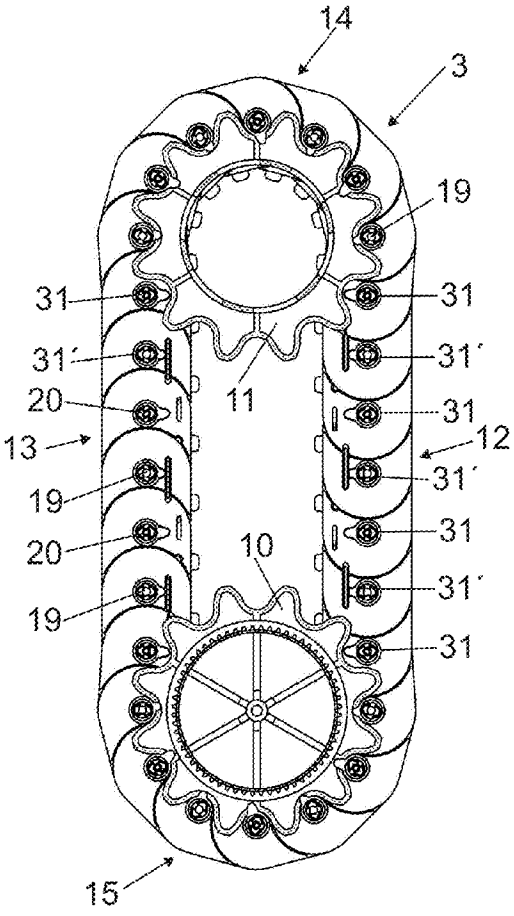
FIG. 22 shows an elevated rear view of the chain of FIG. 14.

As it can be seen in FIGS. 20 to 22, the chain 3 is mounted between a lower driving sprocket 10 and a direction change sprocket 11, describing straight and parallel upward 13 and downward sections 12, and curved upper 14 and lower sections 15.

Figure 2:
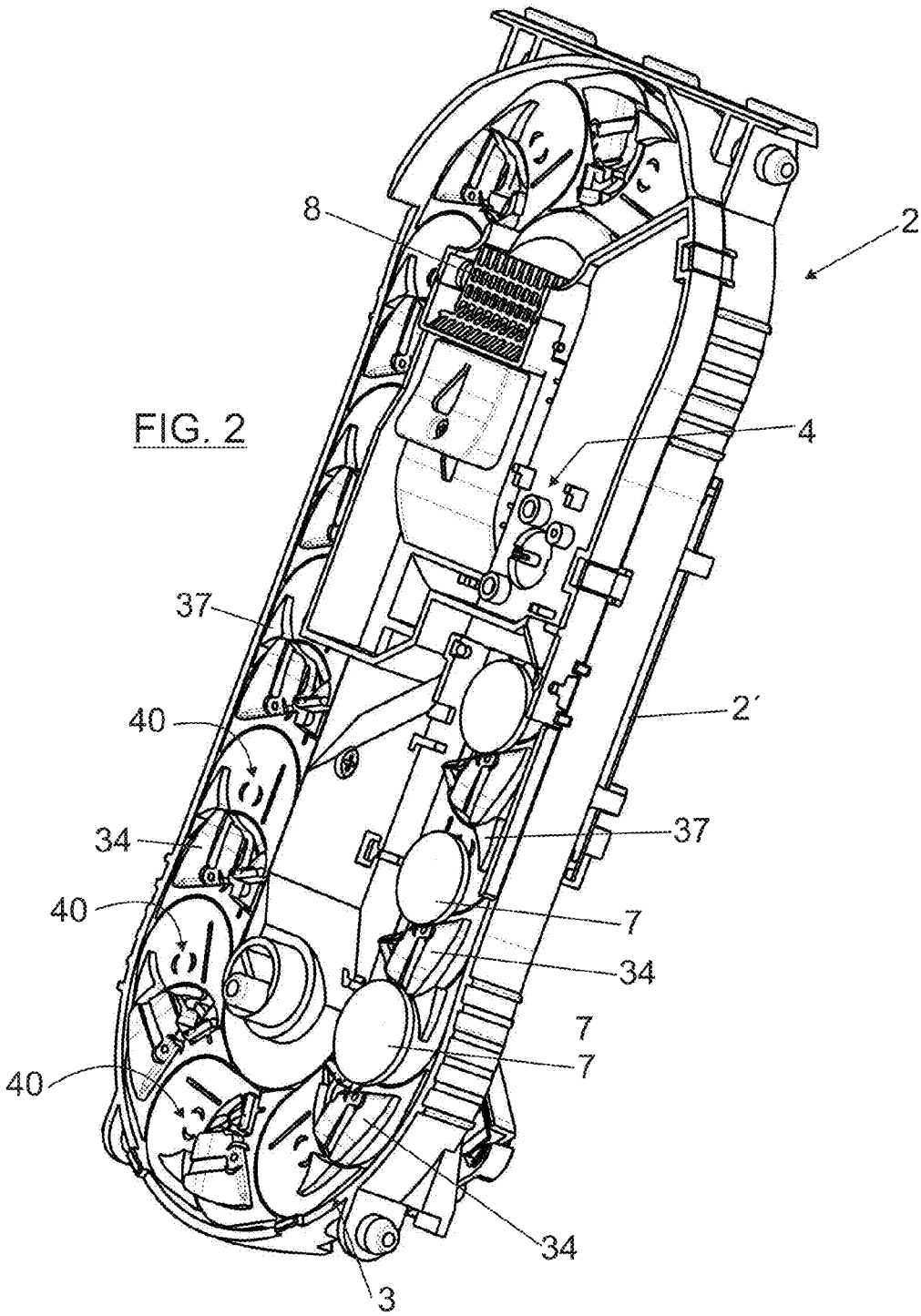
FIG. 2 is a perspective view of the coin extractor, in the sloping position it occupies inside the coin storage unit.
Figure 3:
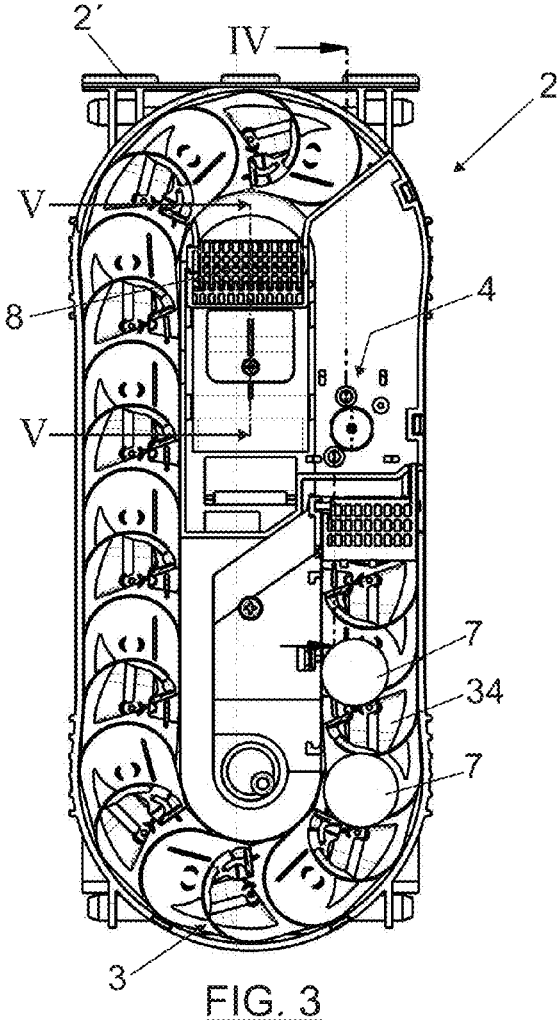
FIG. 3 is an elevated frontal view of the coin extractor of FIG. 2.

As it can be seen in FIG. 2, the chain 3 with sprockets 10 and 11, the coin identifier 4 and the gate 8 of the coin deflector, are mounted on a framework 2', the whole set thereof forming the extractor 2.

The chain 3 comprises two series of links 17 and 18 of flat configuration, which are arranged in alternating positions, as it can be seen in FIG. 17.

As it can be seen in FIGS. 1 and 2, the extractor 2 is in a sloping position, the chain running in this same position, with the upward 13 and downward 12 sections tilted towards the back in an upward position, the flat links 17 and 18 running parallel to the plane defined by the chain 3.

Figure 14:
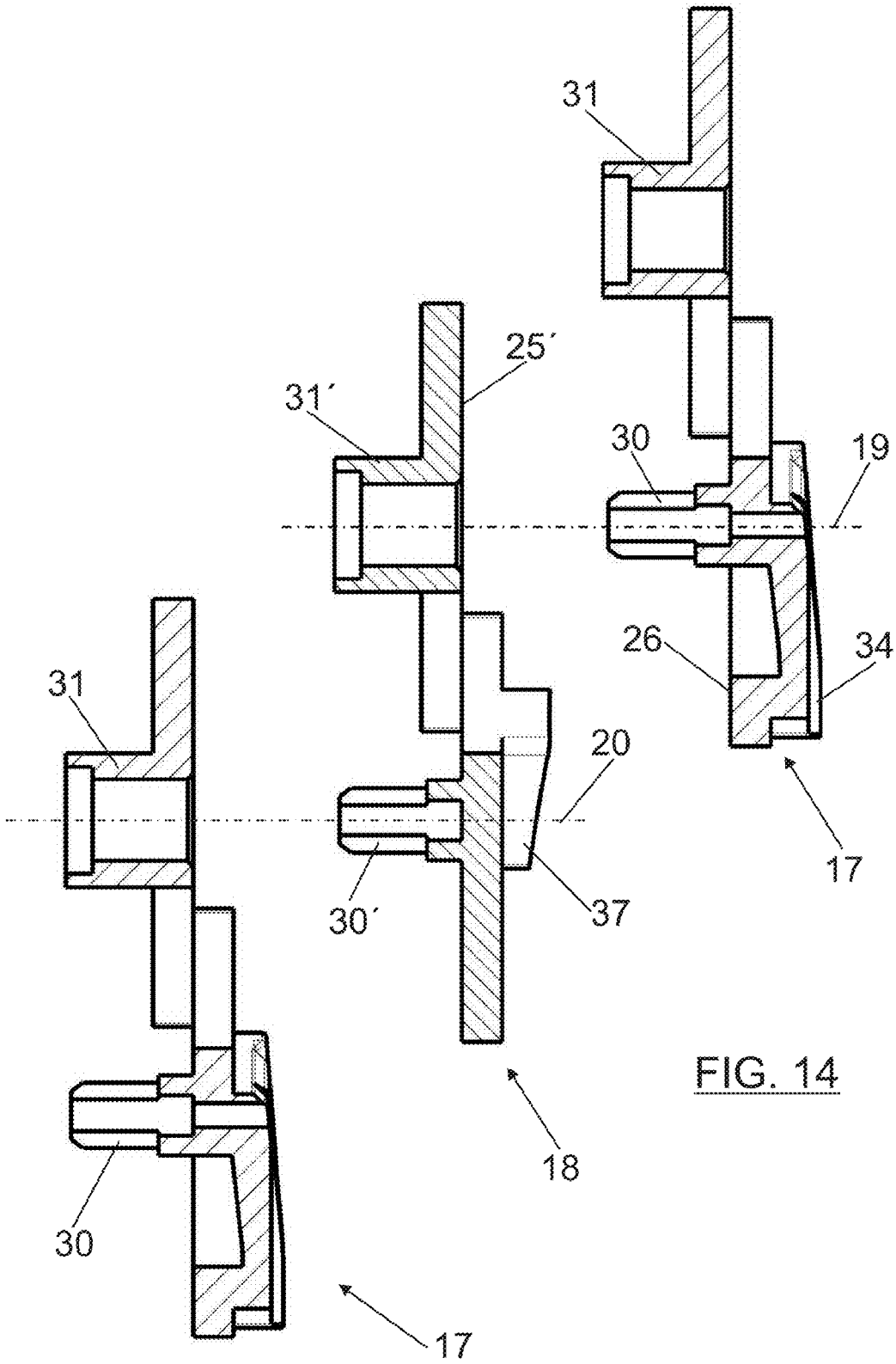
FIG. 14 shows a sectional view of the coupling between both series of links.
Figure 16:
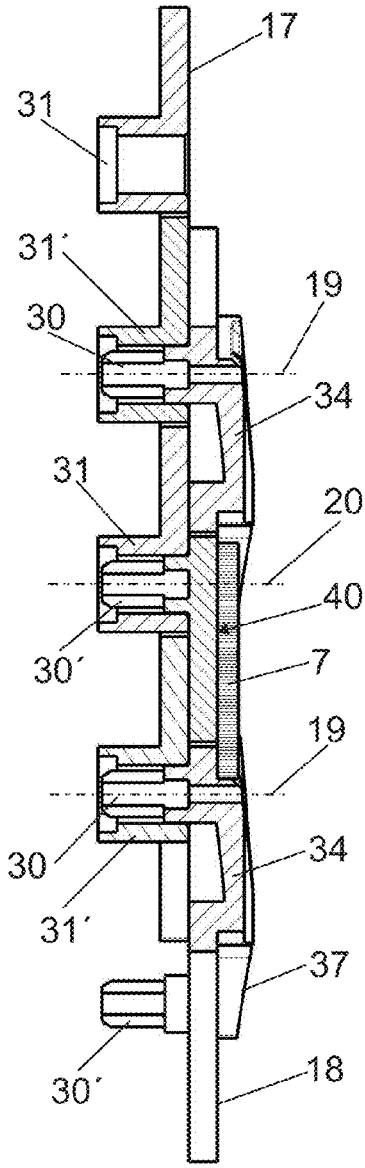
FIG. 16 shows a sectional view of the same links, according to the cut line XVI-XVI of FIG. 15.

As it can be seen in FIGS. 14 and 16, each link 17 and 18 is associated to the adjacent links through two articulation axes 19 and 20 which are perpendicular to said links.

Figure 6:
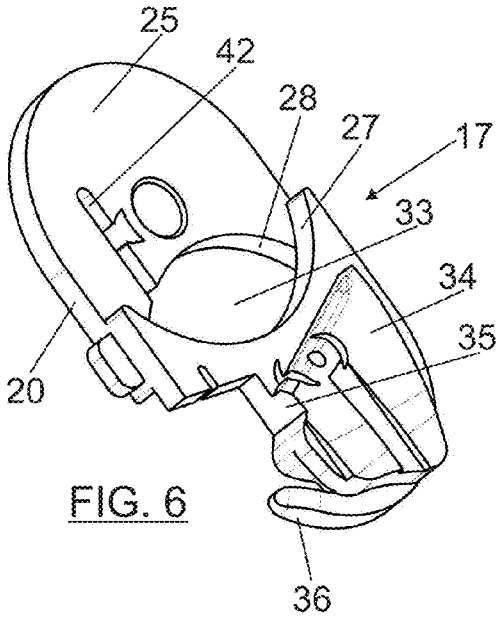
FIG. 6 is a perspective frontal view of one of the links of the first series of links which form the coin extractor chain.
Figure 7:
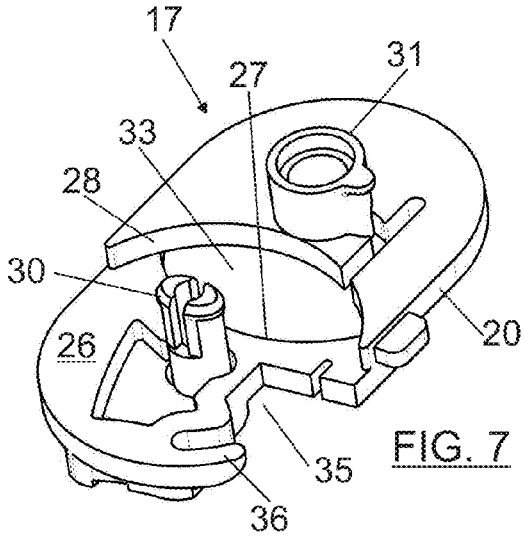
FIG. 7 is a perspective rear view of the same link.
Figure 8:
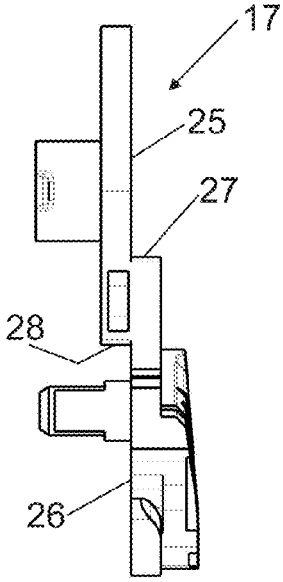
FIG. 8 is a lateral view of the same link.
Figure 9:
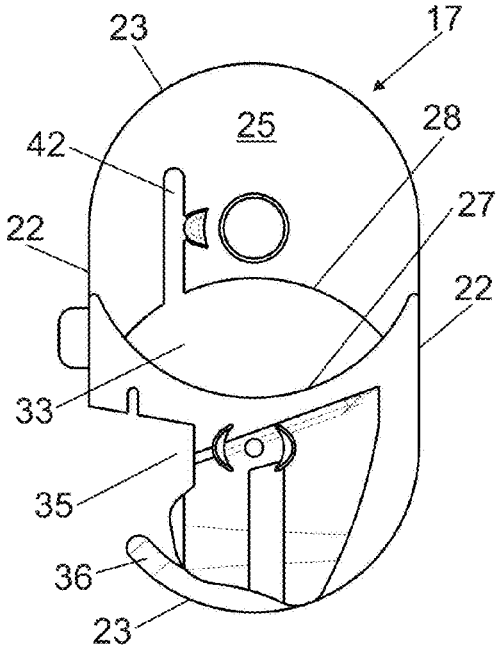
FIG. 9 is an upper plan view of the link of FIGS. 6 to 8.
Figure 10:
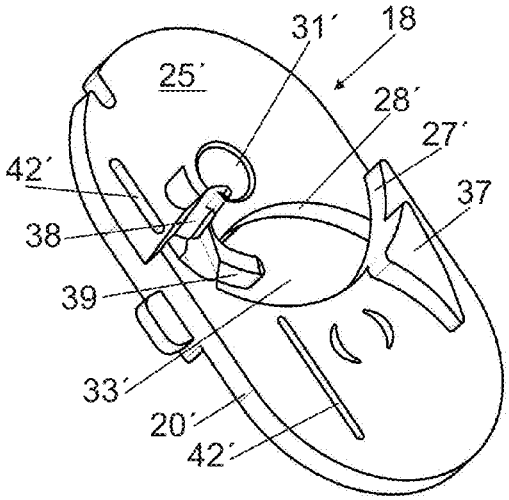
FIG. 10 is a perspective frontal view of one of the links of the second series of links which form part of the coin extractor chain.
Figure 11:
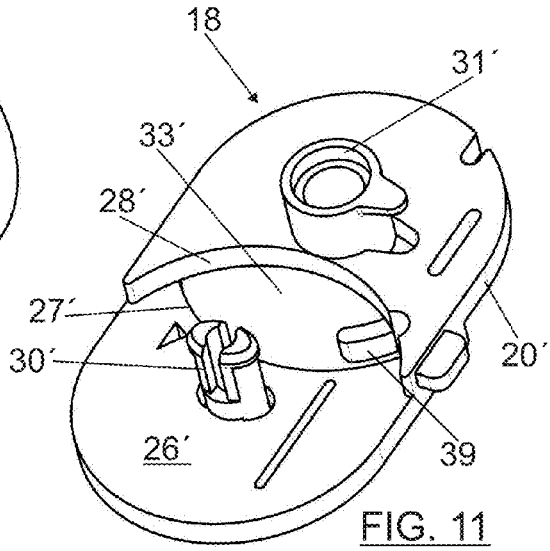
FIG. 11 is a perspective rear view of link of FIG. 10.
Figure 12:
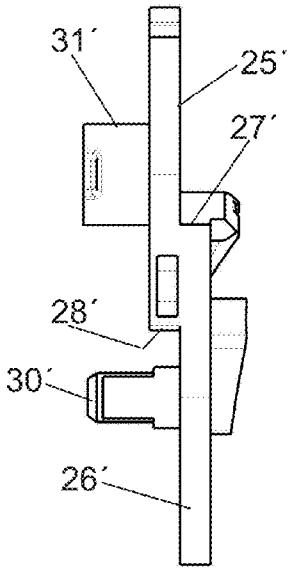
FIG. 12 is a lateral view of the link of FIGS. 10 and 11.
Figure 13:
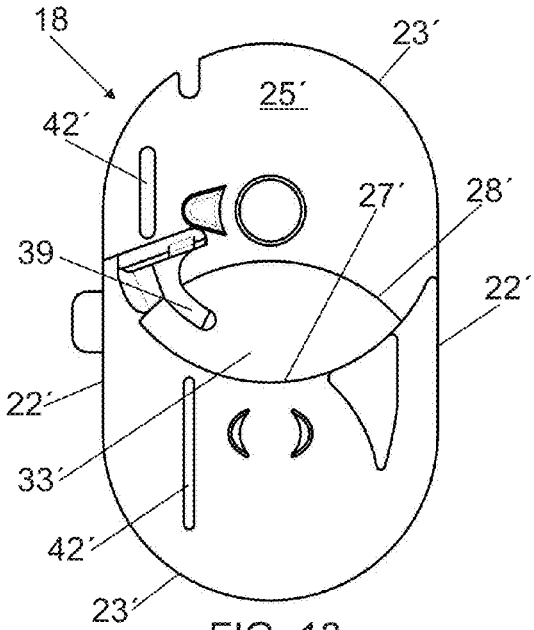
FIG. 13 is an upper plan view of the link of FIGS. 10 to 11.

FIGS. 6 and 9 represent the link 17 of the first series of links, while FIGS. 10 to 13 show the link 18 of the second series. Both sets of links are constituted by plates 20, 20', which are longer than they are wide, as it can be seen better in FIGS. 9 and 13, which are limited by longitudinal straight parallel edges 22-22', and transversal semicircular edges 23-23' having the same radius. Each one of the plates 20-20' has on both surfaces, from opposite semicircular edges 23-23' and between the longitudinal straight edges 22-22', recessed areas which are indicated by numbers 25 and 26 in the link 17 of FIGS. 6 to 9 and with numbers 25' and 26' in the links 18 of FIGS. 10 to 13, recesses which are interiorly limited by circular transversal curve-concave steps, which are indicated by numbers 27 and 28 in the link 17 and by numbers 27' and 28' in the link 18, these circular transversal curve-concave steps having a radius and center coinciding with those of the semicircular edges 23-23' of the plates, so that the steps 27-28 and 27'-28' delimit the opposite semicircular edges 23-23', circular outlines which centers coincide with the articulation axes 19 and 20 of each link, axes which are realized by male pivots 30-30' and female pivots 31-31' protruding from one of the surfaces of the plates 20-20', going through the hole or inner passage of the hollow pivots 31-31' towards the plate to receive the coupling of the male pivot 30-30' of the adjacent plate.

In this way, as shown in FIGS. 14 and 16, the plates 20-20' which form the links 17 and 18 of the first and second series of links are consecutively articulated to one another through the introduction of the male pivot 30-30' of each plate in the female pivot 31-31' of the adjacent plate, as it will be explained later.

The recesses 25-26 and 25'-26', FIGS. 6 to 13, are as deep as half the thickness of the plate 20-20' forming the links 17 and 18. The width of the links is equal to the diameter of the transversal semicircular edges 23-23'and their length ranges between said diameter and its double, so that the transversal curve-concave steps 27-28 and 27'-28' will be secants, determining in each plate a central opening 33-33'.

So far the configuration, dimensions and constitution of the links 17 and 18 is coincidental. However, by the surface opposite the one occupied by the male pivots 30-30', the links 17 present, in the non recessed area, a rib 34 occupying almost the whole of said area, as well as a lateral notch 35 limited by an external bowed pin 36. As for the link 18, it has in the same surface and non recessed area, two small ribs 37 and 38, as well as a small internal pin 39, also bowed.

The lateral notch 35 facilitates the fall of the coins when they reach the upper curved section 14 of the chain. In order to prevent the accidental entering of coins in this lateral notch, the bowed pins 36 and 39 are coupled to one another, preventing the possible entrance of coins.

With the constitution described, to form the chain 3, represented by FIGS. 18 to 22 and as shown in FIG. 14, the recessed area 26 of a link 17 is attached on the recessed area 25' of a link 18, so that the male pivot 30 of the link 17 is introduced through the passing of the female link 31'of the link 18, the rib 34 of the links 18 and the ribs 37 and 38 of the links 18 being directed towards the same side of the chain 3, while on the opposite side there will protrude the female pivots 31 and 31', with the male pivots 30 and 30' introduced through them, these female pivots 31-31' serving for the mounting of the chain 3 on the sprockets 10 and 11, as it can be seen in FIG. 19, thus being the articulation axes 19 and 20 realized by the coupling of the male pivots 30-30' in female pivots 31-31' of the consecutively articulated links, as it can be seen better in FIGS. 16 and 19.

Since the recessed areas 25-26 and 25'-26' of the links 17 and 18 are as deep as half the thickness of the plates 20, when the links couple the non recessed areas thereof they are in a coplanar position, FIGS. 15 to 21, both on the rear and front surface, in which the frontally open cavities 40 are delimited, FIGS. 15 to 18, which bottom is defined by non recessed areas of the two consecutive links 17 and 18, while they are peripherally limited by ribs 34 and 37 belonging to these links, and by ribs 34 and 38 belonging to the links located immediately in front of and behind the two links defining the bottom of the cavity 40.

That is to say, while each cavity 40 is formed in the bottom of two consecutive links, it is peripherally limited by ribs belonging to four links.

The cavities 40 also end by the side or internal edge of the chain 3, as well as by the edge or external side, where they are partially closed through the ribs 37.

Figure 15:
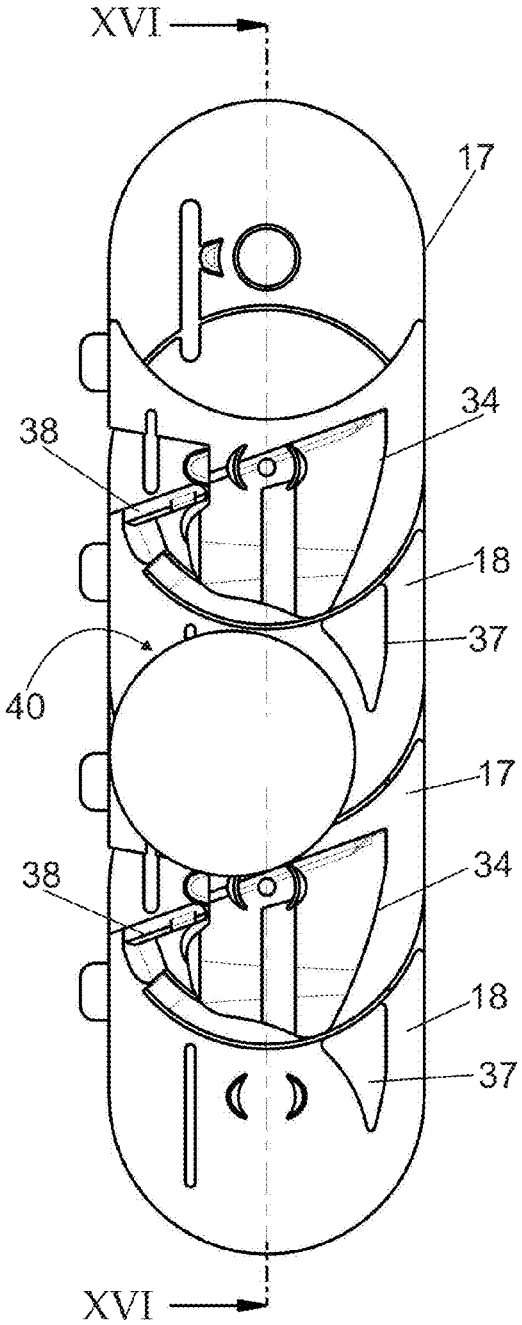
FIG. 15 shows an elevated frontal view of four links of the chain, in the upward section thereof.
Figure 23:
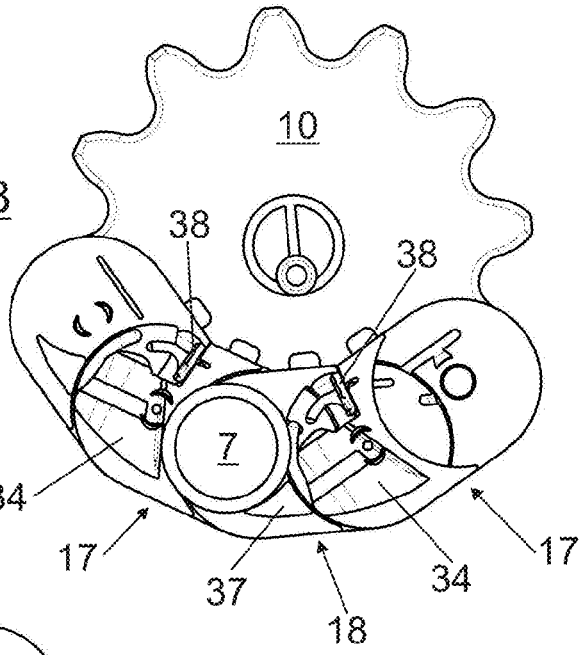
FIGS. 23 to 25 show an elevated partial frontal view of successive phases of reception and dragging of a coin by the chain constituting the coin extractor.
Figure 24:
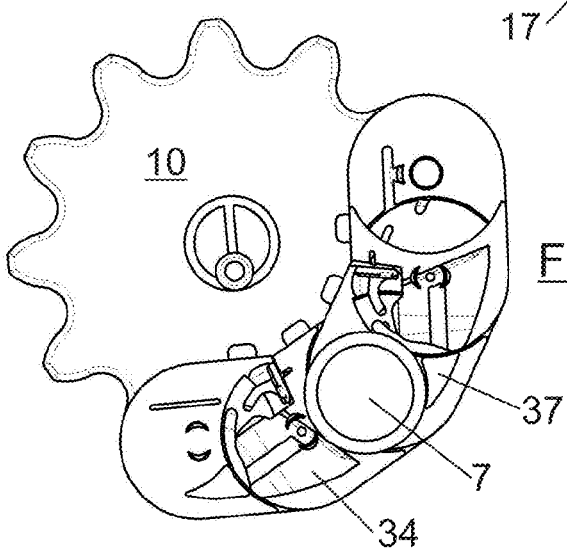
Figure 25:
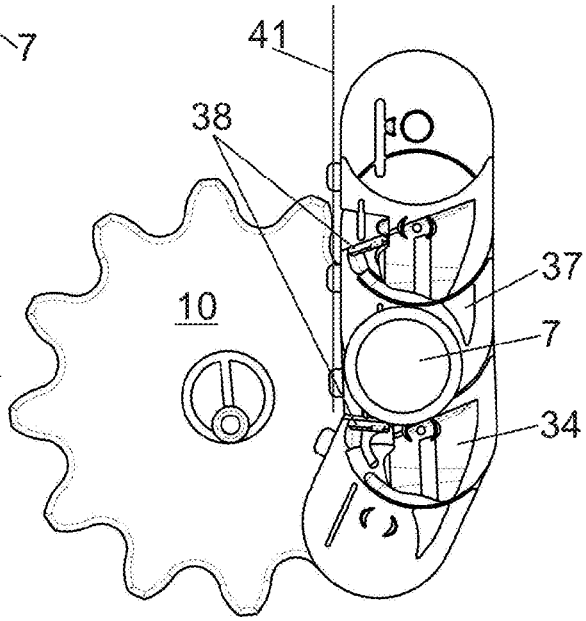

With this arrangement, during the movement of the chain 3 inside the storage unit 1, FIG. 1, the coins 7 couple inside the cavities 40, as shown in FIG. 23, being attached to the bottom of the cavities, FIG. 16, in a position parallel thereto and resting downwardly by its edge against the ribs 34 of the alternating links 17 and in the rib 37 of the intermediate link 18. When the chain runs in the upward section inclined towards the back, FIGS. 1, 2 and 16, the coins 7 are dragged upwardly, resting on the back against the bottom of the cavities 40, defined by non recessed surfaces of consecutive links 17 and 18, being retained by the external side of the ribs 34 and 37, as shown in FIGS. 15, 17 and 25, while interiorly they are prevented from going out through stops and a wall 41, FIG. 1, running close to the upward section 12 of the chain and reaching to the point in which the upper curved section 14 of said chain starts, so that it can fall freely through the hole defined between the ribs 38 belonging to two alternating links 18. The fall of the coin occurs on the gate or deflector 8 which will direct it towards the return channel 9 or towards the return of the storage unit 1, depending on its value, detected when passing through the coin identifier 4.

In the forward or upward section of the chain, as it can be appreciated in FIGS. 15, 17 and 25, the coins, besides resting on one of its larger surfaces on the bottom of the cavity, rest downwardly through their edge on the ribs 34 and 38 of the two links 17 and 18 located immediately behind said coin, being prevented from laterally going outside through the rib 37 of one of the links which form part of the bottom of the cavity 40 carrying the coin 7 and towards the opposite side by the partition 41.

The consecutive links 16 and 17 also have bowed pins 36 and 39 coupled between them along the curved sections of the chain, thus closing the notch 35 of the links 17, so that they prevent the accidental entrance of the coins in undesirable positions. The plates forming the links 17 and 18 also have slots 42-42', FIGS. 6 to 13, to enable the passage of the sensor beams 5, FIG. 4.

In case some of the cavities 40 drag two overlapping coins, the most external one will fall slipping on the surface of the rib 34, for which this surface is inclined so as to facilitate said fall.

The invention claimed is:

1. Coin dispenser, comprising:

a coin storage unit, a coin extractor comprising an endless chain, a coin identifier for coins transported by the endless chain, and a coin deflector directing the coins provided by the endless chain towards an outlet passage or towards a return path, the endless chain comprising:

a first series and a second series of flat alternating links, parallel to a plane defined by said chain and consecutively articulated according to axes perpendicular to the links; forming cavities with dimensions to house a coin, the cavities being interiorly limited by a bottom parallel to the links, the links comprising two consecutive links of different series, and ribs protruding from the two consecutive links; and ribs of a link located immediately in front of said two consecutive links and of the link located immediately behind said two consecutive links, limiting, at least at an inner side of the chain, the outlet passage being wider than a diameter of the coin; the chain being mounted inside the coin storage unit in a sloping position, by a side opposite to a side occupied by the cavities, between an upper sprocket and a lower sprocket delimiting upward straight sections and downward straight sections, upwardly extending with a backward inclination, and upper curved sections and lower curved sections, the upward section limited by the inner side of the chain in which the outlet passage is located, by a wall closing said passage and ending at a position wherein the chain reaches towards the upper curved section, to enable the coins transported by the coin deflector to fall.

2. A dispenser according to claim 1, wherein the links of the first series and the second series comprise plates, with a same outline and dimensions, the plates having a length greater than a width and being limited by straight and parallel longitudinal edges and transverse semicircular edges of a same radius, the plates having on two surfaces, all along a width and from opposite semicircular edges, recessed areas which are interiorly limited by a circular transverse curve-concave step having a radius and center coinciding with a radius and center of a semicircular opposite edge; each link being attached through the recessed areas to recessed areas of adjacent links and related to the adjacent links by articulation axes perpendicular to the links and coinciding with the center of the transverse semicircular edges limiting the recessed areas.

3. A dispenser according to claim 2, wherein the plates forming the links are as wide as a diameter of semicircular transverse edges of the plates and have a length ranging between the diameter and twice the diameter.

4. A dispenser according to claim 2, wherein the recessed areas of the plates forming the links are as deep as half of a thickness of said plates.

5. A dispenser according to claim 2, wherein the articulation axes between the links comprise a male pivot and a female pivot, protruding from each link, by the surface opposite to the surface occupied by the ribs limiting the cavities for the coins and coinciding with the center of the transverse curved edges of the plates forming the links; the female pivot including a pass-through housing through the plate, configured to receive the male pivot of the plate forming one of the adjacent links.

6. A dispenser according to claim 5, wherein the chain is mounted in the toothed wheels through the female pivots.

7. A dispenser according to claim 2, wherein the recessed areas of the bottom of the cavities are formed by a surface of non recessed areas of the two links forming said bottom, wherein a rib protrudes from said surface in the links of the first series, the rib substantially occupying the non recessed area and limiting in the chain two consecutive cavities, wherein two small ribs protrude from the links of the second series, said small ribs partially limiting and acting as an extension of front and rear edges of the rib of the first series.

8. A dispenser according to claim 1, wherein plates forming the links have coplanar bowed pins, the bowed pins being coupled to one another, closing an opening between consecutive links, along the curved sections.

9. A dispenser according to claim 1, wherein plates forming the links have slots for passage of sensor beams of the coin identifier.

* * * * *